United States Patent [19]

Perkins

[11] Patent Number: 4,473,000

[45] Date of Patent: Sep. 25, 1984

[54] AIR BLOWER WITH AIR DIRECTING VANES

[75] Inventor: Lynn W. Perkins, Charlotte, N.C.

[73] Assignee: Vertical Air Stabilization Corp., Charlotte, N.C.

[21] Appl. No.: 444,811

[22] Filed: Nov. 26, 1982

[51] Int. Cl.[3] ..... F24F 13/08

[52] U.S. Cl. ..... 98/40 V; 98/40 B

[58] Field of Search ..... 98/2, 33 A, 40 R, 40 A, 98/40 B, 40 D, 40 N, 40 V, 40 VM, 121 R; D23/112; 34/97; 415/121 G; 416/247 R

[56] References Cited

U.S. PATENT DOCUMENTS 2,697,163 12/1954 Spear ..... 98/40 B 2,950,859 8/1960 Kirk ..... 98/40 V X 3,186,329 6/1965 Kennedy ..... 98/40 A

*Primary Examiner*—Harold Joyce

*Attorney, Agent, or Firm*—Richards, Shefte & Pinckney

[57] ABSTRACT

An air blower adapted to be mounted to the ceiling of a room to create a gentle circulation of air in such room. The blower includes a motor-driven impeller mounted in generally cylindrical housing and a vane unit having a first plurality of relatively large vanes disposed in radial planes with respect to the axis of rotation of the impeller, and a second plurality of relatively small vanes disposed in radial planes equally offset from the larger vanes and disposed adjacent the downstream portion of the large vanes. The vane unit is detachably mounted to the blower housing to permit removal of the vane unit for cleaning.

5 Claims, 4 Drawing Figures

AIR BLOWER WITH AIR DIRECTING VANES

BACKGROUND OF THE INVENTION

In attempting to maintain a generally constant and comfortable temperature level in rooms, particularly large rooms, one major problem which is encountered is the significant variation between the temperature of the air near the ceiling and the air near the floor which results from the well-known principal that warmer air will rise. While the proper placement of heating and air conditioning ducts tend to alleviate this problem, even proper ductwork design does not solve the problem entirely, and the problem manifests itself particularly in large areas such as offices and commercial establishments.

It is apparent that such stratified temperature conditions may tend to create an uncomfortable environment for occupants of the space, and, more importantly perhaps, valuable energy is wasted in an attempt to maintain the lower portion of the room at a temperature level that is not uncomfortable for occupants. For example, when heating a large space, the hottest air will rise to the ceiling, leaving cooler air in the lower portion of the space where the occupants are, and it is therefore necessary to increase the amount of heated air which is dicharged into the room to maintain the lower portion at a comfortable temperature level.

Efforts have been made to deal with this problem by utilizing air moving devices located in the space to move the stratified air upwardly and downwardly to thereby mix the warmer and cooler air and obtain greater temperatures equalization. Familiar examples of such air moving devices are ceiling fans and air blowers mounted in spaced relation to the ceiling of the space to create downwardly directed air currents. However, many of these devices are quite inefficient and/or expensive because they do not effectively and efficiently convert the generally centrifugal air flow generated by a rotating impeller to an axial air flow that can be directed downwardly in a vertical direction to obtain the maximum efficiency for the device in equalizing the temperature of the stratified air. For example, ceiling fans are very inefficient because there is virtually no structure to properly channel the generally centrifugal air currents generated by the fan, and known ceiling mounted blowers, while they generally include some type of vanes for directing the air downwardly, utitilize such vanes in an inefficient manner which requires the use of a larger motor and a larger impeller to get the desired amount of air flow exiting downwardly from the blower. This inefficiency therefore increases the initial costs of the devices, and, because the devices are generally operated continuously, also increases significantly the energy consumption and operating costs of the devices.

In accordance with the present invention, a blower of the aforesaid type is provided with a unique air directing vane arrangement which is quite efficient and which creates an air flow that, upon leaving the blower, is directed downwardly in an essentially vertical flow path that provides excellent results in moving the air from the ceiling area to the lower portion of a room.

SUMMARY OF THE INVENTION

Briefly summarized, the blower of the present invention includes a motor driven impeller mounted for rotation in a housing having an air inlet in the top portion thereof and a cylindrical portion extending downwardly from the impeller to direct air downwardly therefrom. A unique air-directing vane is fixed to the extending end of the housing, and includes a plurality of large vanes disposed in radial planes and extending along the entire length of the vane arrangement, such larger vanes having a relatively large circumferential spacing from one another so as to create a minimum amount of resistance to the centrifugal air flow being generated by the impeller while still initially straightening out said air flow into a more vertical or axial flow path. Additionally, a plurality of small radial vanes are provided adjacent the bottom portion of the larger vanes and circumferentially offset therefrom so that as the air moves along the larger vanes it will, after some initial straightening, pass through the spacing between the larger vanes and the small vanes to thereby impose a greater straightening effect on the air flow in a very efficient manner.

Preferably, the vane arrangement includes a cylindrical outer wall portion in which the large vanes are radially disposed, and a cylindrical inner wall portion at the lower end of the outer wall portion, the smaller vanes being disposd radially between the inner and outer cylindrical wall portions. Also, the vane arrangement is preferably fabricated as an integral unit which is selectively detachable from the blower housing so that the unit can be readily removed for cleaning, when necessary.

DESCRIPTION OF THE PREFERRED EMBODIMENT

Figure 1:
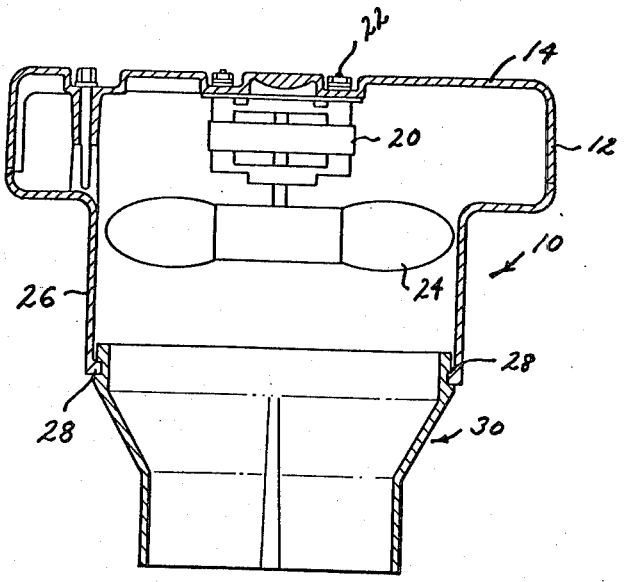
FIG. 1 is a vertical sectional view taken through the center of the blower of the present invention.
Figure 2:
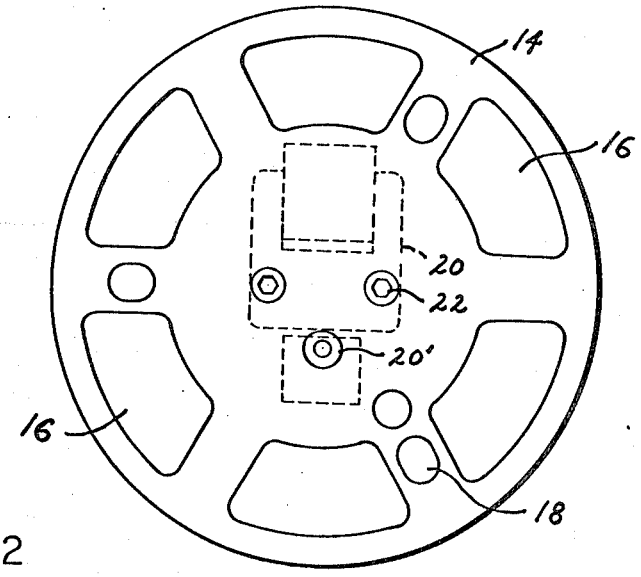
FIG. 2 is a plan view of the blower illustrated in FIG. 1.

Looking now in greater detail at the accompanying drawings, FIGS. 1 and 2 illustrates an air blower 10 embodying the present invention.

The blower 10 includes a housing 12 having a top wall 14 formed with a plurality of air inlet openings 16 and holes 18 for use in mounting the blower 10 to the ceiling of a room with the top wall 14 normally being spaced from the ceiling by about twelve inches to permit proper air flow into the air inlet opening 16. An electric motor 20, preferably controlled by a rheostat 20', is mounted in the top wall 14 by bolts 22 for driving a rotating air moving impeller blade 24, and the housing 12 includes a generally cylindrical portion 26 which surrounds the impeller 24 and extends downwardly therefrom.

The lower extending end of the cylindrical housing portion 26 is formed with inwardly directed flanges (see FIG. 1), and an air directing vane unit 30 is detachably mountd on the cylindrical housing portion 26 by grooves 32 which receive the flanges 28 and which also include openings 34 which are large enough to permit the flanges 28 to be placed in position to enter the grooves 32. Thus, the entire vane unit 30 may be easily mounted on the cylindrical housing portion 26 by disposing the vane unit 30 with the flanges 28 received in the openings 34 and then rotating the vane unit 30 slightly until the flanges 28 are received in the grooves 32. Likewise, the vane unit 30 may be readily detached from the housing portion 26 by rotating the vane unit 30 in the opposite direction until the flanges 28 are aligned with the openings 34.

Figure 3:
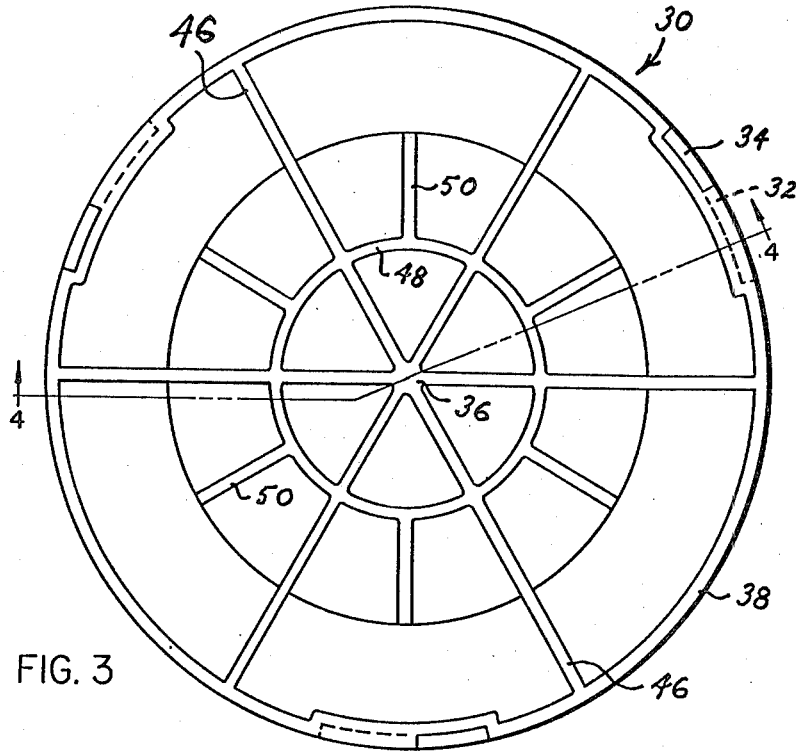
FIG. 3 is a plan view of the air directing vane unit of the blower illustrated in FIG. 1.
Figure 4:
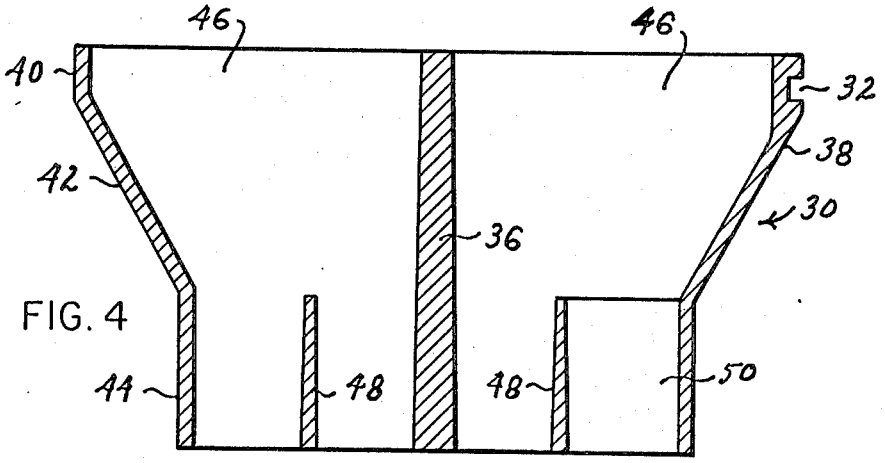
FIG. 4 is a section view taken along lines 4—4 in FIG. 3.

As best illustrated in FIGS. 3 and 4, and vane unit 30 includes a center post 36 extending axially along the entire vertical length thereof, and an outer cylindrical wall 38 having a larger upper cylindrical portion 40 slightly smaller in diameter than the cylindrical housing portion 26 so as to be received therein as shown in FIG. 1, an inwardly tapered cylindrical portion 42, and a lower cylindrical portion 44 at the downstream or extending end of the vane unit 30. A plurality of large flat vanes 46, preferably six in number, extend from the center post 36 to the outer wall of the vane unit 30 so as to be disposed in radial planes with respect to the axis of rotation of the impeller 24, the large vanes 42 having an axial extent corresponding to the axial length of the vane unit 30. An inner cylindrical wall 48 is disposed circumferentially about the center post 36 at the downstream or exit end of the vane unit 30, and the inner cylindrical wall 48 has an axial extent that is equal in length to the axial extent of the lower cylindrical wall portion 44. A plurality of small flat vanes 50, also preferably six in number, extend radially from the inner wall 48 to the lower cylindrical portion 44 of the vane outer wall 38, the small vanes 50 having an axial extent corresponding to the axial extent of the inner wall 48 and the lower cylindrical portion 44. The small vanes 50 are preferably disposed so that each of them is circumferentially offset or spaced from two adjacent large vanes 46 so as to be located midway therebetween.

Although the blower 10 of the present invention may be constructed in various sizes, the vane unit 30 in a typical blower size would have an overall axial length of 3 3/16 inches, with the small vanes 50 having an axial length of $1\frac{1}{4}$ inch, and the diameter at the inlet end of the vane unit 30 is 6 inches, with the diameter at the outlet end being $4\frac{1}{4}$ inches. The diameter of the inner wall 48 would be $2\frac{1}{8}$ inches, and the thickness of the large vanes 46 and the small vanes 50 would typically be 0.07 inch.

In operation, the blower 10 would be mounted to a ceiling at a spacing of about 12 inches therefrom as described above, and the motor 20 is energized to rotate the impeller 24 at a desired speed. This rotation of the impeller 24 generates an air current that swirls downwardly in the cylindrical housing portion 26 until it reaches the vane unit 30 where the swirling air encounters the falt, radial surfaces of the upper portion of the large vanes 46 which tend to reduce the swirl and partially straighten the air current. Because there are only a relatively few large vanes 46 which have a substantial circumferential spacing from one another, the resistance or friction imposed on the swirling air leaving the impeller 24 is kept to a minimum. As the now partially straightened air continues to pass between the large vanes 48 and through the tapered portion 42 of the vane unit outer wall 38, it encounters the additional smaller vanes 50 disposed midway between the larger vanes 46 and must therefore pass through twelve smaller areas defined by the larger vanes 46 and the smaller vanes 50 as best seen in FIG. 3 which serve to substantially fully straighten the path of the air whereby it leaves the vane unit 30 in a substantially vertical direction. It is significant that when the air reaches the smaller spaces between the large vanes 46 and the small vanes 50, it has already been partially straightened by the large vanes 46 and, therefore, these small spaces present only minimum resistance to the flow of the air through the lower portion of the vane unit 30 while still fully straightening the air flow so that it will be directed in a substantially vertical flow path that will provide maximum efficiency for moving the air from the ceiling to the flow area of the room in which the blower is mounted.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. An air blower adapted to be mounted to a ceiling of a room to create a gentle circulation of air in such room, said blower comprising a housing in which a motor-driven impeller is mounted for rotation to create an air flow, said housing including an air inlet in the upper portion thereof and a generally cylindrical portion surrounding said impeller and extending downwardly therefrom, and air directing vane means fixed to the extending end of said cylindrical housing portion to receive air therefrom and to direct said air in a flow path extending generally parallel to the axis of rotation of said impeller, said vane means including a first plurality of relatively large vanes disposed in planes extending axially with respect to said axis of rotation and a second plurality of relatively small vanes disposed in planes extending axially with respect to said axis of rotation and offset from said planes of said large vanes, said small vanes being disposed adjacent the downstream portions of said large vanes and having a smaller axial extent than said relatively larger vanes.

2. An air blower as defined in claim 1 and further characterized in that said vane means includes an outer cylindrical wall portion with said large vanes extending radially from the center thereof and having an axial extent corresponding to the axial length of cylindrical wall portion, and with said small vanes extending radially with respect to said center.

3. An air blower as defined in claim 2 and further characterized in that said vane means includes an inner cylindrical wall portion extending coaxially with said outer cylindrical wall portion adjacent the lower end thereof with said small vanes extending radially between said inner and outer cylindrical wall portions.

4. An air blower as defined in claim 2 and further characterized in that each of said smaller vanes is offset from two adjacent large vanes and equally spaced therefrom.

5. An air blower as defined in claim 1 and further characterized in that said vane means is detachably mounted on said housing.

* * * * *